US005135123A

United States Patent [19]

Nairn et al.

[11] Patent Number: 5,135,123

[45] Date of Patent: Aug. 4, 1992

[54] TAMPER-EVIDENT CLOSURE WITH A SEPARATELY FORMED BREAK AWAY BAND

[75] Inventors: James F. Nairn, St. Charles; Richard J. Petro, Mokena, both of Ill.

[73] Assignee: Phoenix Closures, Inc., Naperville, Ill.

[21] Appl. No.: 586,366

[22] Filed: Sep. 20, 1990

[51] Int. Cl.[5] ..... B65D 41/34

[52] U.S. Cl. ..... 215/252; 215/232; 215/230

[58] Field of Search ..... 215/252, 258, 232, 230; 220/359

[56] References Cited

U.S. PATENT DOCUMENTS

| | | | |
|---|---|---|---|
| 3,980,195 | 9/1976 | Fillmore . | |
| 4,432,461 | 2/1984 | Mumford et al. . | |
| 4,493,427 | 1/1985 | Wolkonsky | 215/230 |
| 4,530,437 | 7/1985 | Gray et al. | 215/252 |
| 4,550,844 | 11/1985 | Lininger . | |
| 4,567,993 | 2/1986 | Albrecht et al. | 215/252 |
| 4,595,110 | 6/1986 | Herr . | |
| 4,679,696 | 7/1987 | Bonnenfant et al. | 215/252 |
| 4,700,859 | 10/1987 | Gregory | 215/252 |
| 4,702,383 | 10/1987 | Wender | 215/232 |
| 4,768,666 | 9/1988 | Kessler | 215/232 |
| 4,807,771 | 2/1989 | Roy et al. . | |
| 4,919,285 | 4/1990 | Roof et al. | 215/230 |

FOREIGN PATENT DOCUMENTS

| | | | |
|---|---|---|---|
| 2276238 | 1/1976 | France | 215/252 |

*Primary Examiner*—Stephen P. Garbe
*Assistant Examiner*—Stephen Cronin
*Attorney, Agent, or Firm*—Welsh & Katz, Ltd.

[57] ABSTRACT

A method of manufacturing a tamper-evident closure includes providing a closure with a skirt having a lower edge, providing a separate break away band, and securing the band to the lower edge of the closure. The band may be secured to the lower edge by ultrasonic welding or by a suitable adhesive. The band is preferably provided with a plurality of spaced, relatively thin ribs which serve as attachment points.

11 Claims, 1 Drawing Sheet

TAMPER-EVIDENT CLOSURE WITH A SEPARATELY FORMED BREAK AWAY BAND

BACKGROUND OF THE INVENTION

The present invention relates generally to closures for containers, and specifically to a tamper-evident closure having a separated break away band, and a method of manufacturing such a closure.

Various configurations of tamper-evident container closures are known in which a frangible band breaks away from the closure upon opening. The band is connected to the closure by a number of relatively thin, easily severable bridges or pads, and remains on the container finish upon the initial opening of the container.

U.S. Pat. Nos. 4,550,844 and 4,807,771 disclose closures including a large number of tabs extending upwardly and inwardly from the base of the band and abutting a large annular shoulder projection or breaker ledge on the container finish beneath the screw thread to cause separation of the tamper-evident band upon the first opening of the container. Such closures require a multi-step production system to bend the tabs into an upwardly projecting position. Also, U.S. Pat. No. 4,807,771 discloses that such closures are often unsatisfactory for use on relatively larger-mouthed containers.

Another disadvantage of conventional closures having integrally molded break away bands is that the void area between the bridges or pads must be created by molds having side-action capability or by a second cutting operation. This process increases the complexity and cost of producing such closures.

A further disadvantage of conventional tamper-evident closures having break away bands is that the break away band often fails to disengage from the closure upon the initial opening of the container. This is due to the limitations in break away band configuration imposed by integrally molding the band to the closure.

A still further disadvantage of conventional tamper-evident closures employing break away bands is that the tamper evident band is easily visible, and may restrict container styling alternatives.

Thus, an object of the present invention is to provide a tamper-evident closure in which the break away band is readily detached from the closure upon the initial opening thereof.

A further object of the present invention is to provide a method of manufacturing a tamper-evident closure in which the break away band is molded separately from the closure, and is subsequently secured to a lower edge of the closure.

A still further object of the present invention is to provide a tamper-evident closure which may be successfully employed on large-mouthed containers.

SUMMARY OF THE INVENTION

Accordingly, the method of the invention provides a tamper-evident closure, and a method for manufacturing such a closure, wherein a closure and a break away band are separately provided, and the break away band is secured to the lower edge of the closure, such as by ultrasonic welding or by a suitable adhesive. In the preferred embodiment, the band is provided with at least one relatively thin rib which may be disposed upon the top of the band to form the easily breakable attachment point between the band and the closure.

DESCRIPTION OF THE PREFERRED EMBODIMENT

Figure 1:
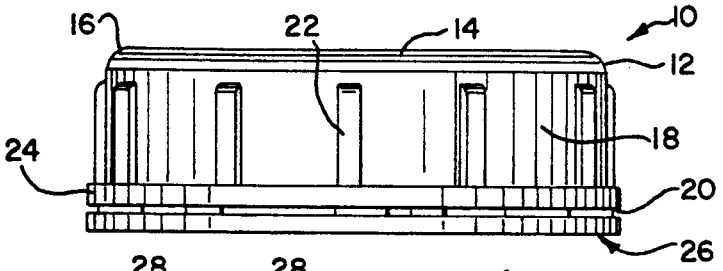
FIG. 1 is a front elevational view of a tamper-evident closure produced according to the present method.
Figure 2:
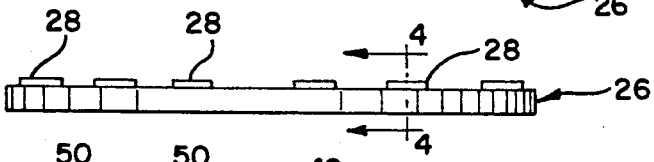
FIG. 2 is a front elevational view of the break away band of the closure depicted in FIG. 1.

Referring now to FIGS. 1, 2, 4 and 5, the closure of the invention is generally designated 10. The closure 10 includes a body 12 having a top surface 14 with an outer peripheral edge 16. An annular skirt 18 depends from the edge 16, and is provided with a lower edge 20. A plurality of spaced, vertical ribs 22 are disposed on an outer surface of the skirt 18 to allow the closure 10 to be installed upon a container by automatic capping equipment, as well as to facilitate gripping or manipulation by the user. The skirt 18 is provided with inwardly projecting helical threads 23 on an inner surface (best seen in FIG. 5). An annular ring 24 is integrally formed at the lower edge 20 of the skirt 18. The closure 10 may be made of a suitable polymeric or plastic material, such as polypropylene or polyethylene, however the use of other materials is contemplated. The preferred process of manufacturing the closure 10 is by injection molding.

A break away band 26 is secured in slightly spaced relationship to the lower edge 20 by a plurality of generally horizontally extending ribs 28 (best seen in FIG. 4) located on an upper surface 30 of the band. The ribs 28 are relatively thin in cross-section in comparison to the cross-sectional width of the band 26. In addition, the ribs 28 are relatively short compared to the band 26, having a height 'H' on the order of from 0.005 to 0.010 inches. Although they are depicted as being generally wedge-shaped, the ribs 28 may be provided in any desired shape which will suit a given application. The ribs 28 are disposed about the band 26 in spaced arrangement to facilitate separation of the band from the closure body 12 upon the initial opening of the closure 10. The specific number and spacing of the ribs 28 may change depending on the particular closure and the materials employed.

The band 26 also has an outer surface 32 and an inner surface 34. The diameter of the outer surface 32 preferably corresponds to that of the annular ring 24, so as to present an aesthetically pleasing appearance. In some cases, the close proximity of the band 26 to the closure body 12 will cause it to appear to be an integral part of the ring 24, and will not resemble a conventional tamper evident closure with a break away band. The inner surface 34 is provided with an inwardly projecting annular bead 36.

The band 26 is produced separately from the closure body 12, and is also preferably produced of polymeric or plastic material which is injection molded. Aside from providing a greater variety of configurations for the band 26, another advantage of producing the band separately from the closure body 12 is that the band may be molded of a different colored polymeric material, or of a different type of polymeric material, than is used for the closure body.

An open-topped container 38 (best seen in FIG. 5) includes a neck or finish 40 having an external screw thread 42 and an annular projecting shoulder or breaker ledge 44 disposed beneath the level of the thread 42. The ledge 44 permits a one-way engagement between the bead 36 and the finish 40, in that on the assembled closure 10, relatively low force is required to thread the bead over the ledge, and once over the ledge, the bead makes it difficult for the band 26 to move upwards. The engagement of the bead 36 with the ledge 44 thus facilitates the breaking away of the band 26 from the closure body 12 once the closure 10 is rotated in a counterclockwise manner, for the ledge 44 holds the bead 36 and prevents upward movement of the band 26.

Another advantage of separately molding the band 26 is that the bead 36 may be provided in any one of a number of desired configurations. In the preferred embodiment, the bead 36 has a sharply angled lower edge 43 for easy threading action over the ledge 44, and a relatively horizontal surface 45 (best seen in FIG. 4) for positive engagement with the ledge 44. However, the bead 36 may be provided in any desired shape which provides the desired "easy on—difficult to remove" characteristics. It is contemplated that use of the present band 26 including the bead 36 as illustrated will enable tamper evident closures with break away bands to be used successfully on larger mouthed containers.

Figure 3:
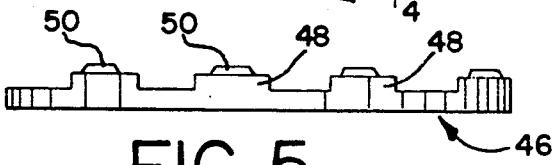
FIG. 3 is a front elevational view of an alternate embodiment of the break away band of FIG. 2.
Figure 4:
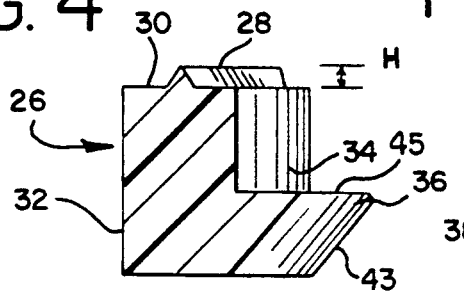
FIG. 4 is a sectional view taken along the line 4—4 of FIG. 2 and in the direction generally indicated.
Figure 5:
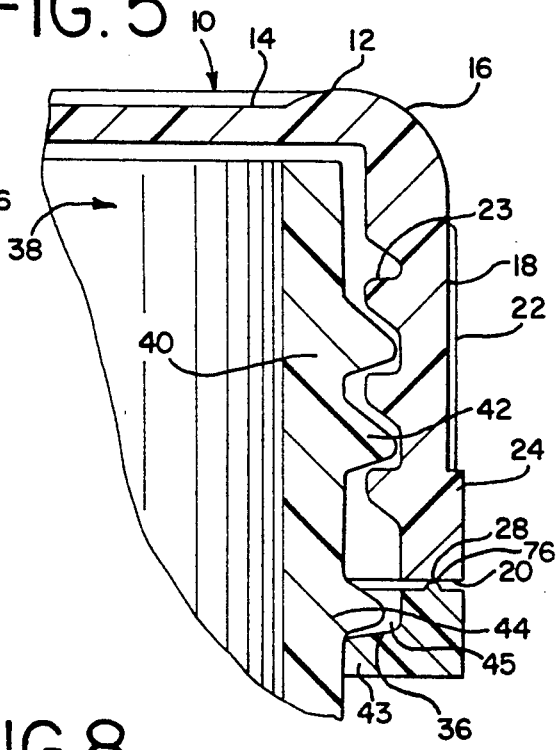
FIG. 5 is a fragmentary vertical sectional view of the closure as shown in FIG. 1 shown secured upon the finish of a container.

Referring now to FIG. 3, an alternate embodiment of the band 26 is indicated as 46. The band 46 is generally similar to the band 26, and differs principally from the band 26 by having a plurality of spaced, upwardly projecting bridges or pads 48 of the type found in conventional closures having break away bands. Each pad 48 is preferably provided with a relatively thin, generally horizontally extending rib 50 which is similar in configuration to the ribs 28.

Figure 6:
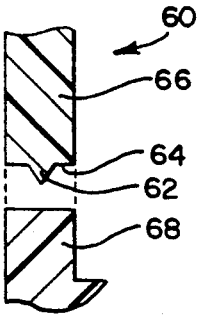
FIG. 6 is a diagrammatic fragmentary vertical sectional view of an alternate embodiment of the tamper-evident closure depicted in FIG. 1.

Referring now to FIG. 6, an alternate embodiment of the closure 10 is generally indicated at 60. The closure 60 is generally similar to the closure 10, and basically differs from the closure 10 in that at least one, and preferably several relatively thin ribs 62 are located on a lower surface 64 of a closure body 66, instead of on the separate break away band 68. If a plurality of ribs 62 are provided, they are disposed in spaced relationship to each other.

Figure 7:
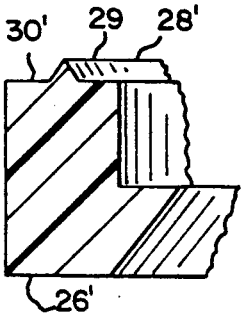
FIG. 7 is an alternate embodiment of the break away band of FIG. 2.

Referring now to FIG. 7, another alternate embodiment of the band 26 is indicated at 26'. The band 26' is substantially similar to the band 26, with the major exception being that a single annular rib 28' is provided and is disposed upon an upper surface 30' of the band 26'. The rib 28' may be provided with an upper edge 29 having a thickness on the order of 0.015±0.005 inches. If desired, and depending on the application, the band 26' may be provided in various configurations, such as by tapering the upper surface 30' to terminate in the narrowed rib 28'.

A significant feature of the present closure 10, is that the break away band 26, as well as its alternate forms 26', 46 and 60, is manufactured separately from the closure body 12. In view of the fact that the closure 10 is preferably manufactured by injection molding, this means that the break away band is produced using a separate mold. In this manner, the ribs 28 and 28', as well as the pads 48 and corresponding ribs 50, may be produced by a standard type mold, eliminating the side-action molds required in the production of conventional closures having integrally molded break away bands. Still another advantage of separately providing the band 26 is that standard or stock closure bodies 12 may be converted into tamper evident closures merely by adding one of the present bands.

Figure 8:
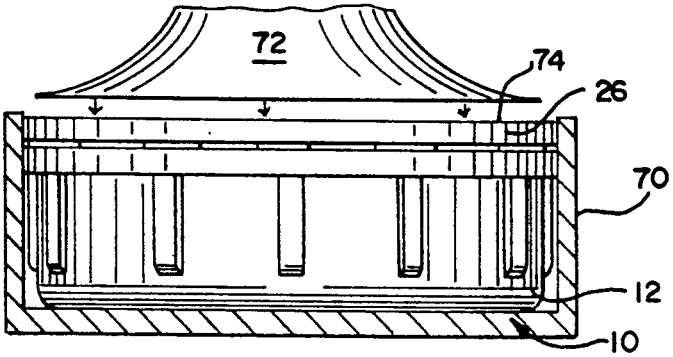
FIG. 8 is a diagrammatic front elevational view, in partial section, of a closure incorporating the invention disposed in an ultrasonic welding apparatus.

Referring now to FIG. 8, another aspect of the present closure 10 is that some means must be found to secure the band 26 to the closure body 12. In the preferred embodiment, this is accomplished by ultrasonic welding. The closure body 12 and the separate break away band 26 are placed in an inverted position in an ultrasonic welding fixture diagrammatically represented at 70. An ultrasonic welding horn 72 is lowered into operational proximity to a lower surface 74 of the band 26.

The high frequency vibrations emitted by the horn 72 are transmitted to the band 26 and travel to the joint area or the area of contact between the band 26 and the closure body 12. At the joint area, the vibrations are dissipated in the form of frictional heat which melts or softens the thin ribs 28 to weld the joining surfaces. The shape of the ribs 28, which form a so-called butt joint with the upper surface 30 of the band 28, results in the ribs acting as energy directors, promoting relatively rapid softening/welding of the ribs before damage occurs to the closure body 12 or to the band 26.

In this manner, the ultrasonic vibrations cause the ribs 28 to deform slightly (best seen in FIG. 5) and fuse the lower edge 20 to the upper surface of the band 26 at the areas of the ribs 28. The band 26 is thus fixed in a slightly spaced relationship relative to the closure body 12. It has been found that the present method of securing the band 26 to the closure body 12 results in a comparable separation of these components as is encountered with conventional closures having integrally molded break away bands.

The band 26 may alternatively be secured to the closure body by the application of a suitable adhesive 76 (best seen in FIG. 5) to the ribs 28, or to the surface 20 in the areas of contact of the ribs 28. The adhesive 76 may be any conventional product which is capable of adhering polymeric materials together, including, but not limited to, thermoplastic-type hot melt adhesives composed of polymers such as polyamides, polyesters, ethylene-vinyl acetate copolymers, and polyethylene, as well as solvent type adhesives, such as methylene chloride.

Thus, the present invention provides a tamper-evident closure which is less complicated and less costly to produce than conventional break away band type closures, and which provides greater design and manufacturing flexibility. By molding the break away band 26 separately from the closure body 12, the band may be configured to suit a wider variety of applications so as to assure easy detachment of the band from the closure body, and to achieve more effective engagement between the band and the breaker ledge on the container.

While a particular embodiment of the closure of the invention has been shown and described, it will be appreciated by those skilled in the art that changes and modifications may be made thereto without departing from the invention in its broader aspects and as set forth in the following claims.

What is claimed is:

1. A tamper-evident closure comprising:

a body having a top;

a depending skirt secured to the periphery of said top and having a generally horizontally planar lower edge;

a separate break away band having a generally horizontally planar top surface, said band being secured to the lower edge of the skirt only by at least one rib, said at least one rib located on said top surface of said band and projecting upwardly from said band for securing said band to said skirt, said at least one rib also being the point from which said band breaks away as a unit from said lower edge of said skirt;

said at least one rib having a height of from 0.005 to 0.010 inches and having a thickness of 0.015 inches with a tolerance of ±0.005 inches; and said closure produced by providing said body separately from said band, and subsequently attaching said band to said closure, with said at least one rib being the only attachment and engagement point between said band and said skirt.

2. The closure as defined in claim 1 wherein said band is provided with a plurality of upwardly projecting pads disposed in spaced relationship around the periphery of said band, a top surface of at least one of said pads having said at least one rib upwardly projecting therefrom, said at least one rib being the only attachment point for securing said band to said skirt.

3. The closure as defined in claim 1 wherein said band has an inwardly projecting bead.

4. The closure as defined in claim 1 wherein said closure is manufactured of polymeric materials, said band being manufactured of a different polymeric mateial than said closure body.

5. The closure as defined in claim 1 wherein said closure is manufactured of polymeric materials, said band being manufactured of a different colored polymeric material than said closure body.

6. The closure as described in claim 1 wherein said at least one rib is molded as a single annular rib.

7. A tamper-evident closure comprising:

a body having a top;

a depending skirt secured to the periphery of said top and having a generally horizontally planar lower edge;

a break away band secured in relatively close proximity to the lower edge of the skirt, such that said band appears to be integral with said lower edge of said skirt;

said band having a generally horizontally planar top surface being provided with a plurality of upwardly projecting pads disposed in spaced relationship around the periphery of said band, a top surface of at least one of said pads having an upwardly projecting rib configured to be the only attachment and engagement point for securing said band to said skirt;

each of said ribs having a height of from 0.005 to 0.010 inches, and a thickness of 0.015 inches with a tolerance of ±0.005 inches; and said closure being produced by providing said body separately from said band, and subsequently attaching said band to said closure.

8. The closure as defined in claim 7 wherein said band has an inwardly projecting bead.

9. The closure as defined in claim 7 wherein said closure is manufactured of polymeric materials, said band being manufactured of a different polymeric material than said closure body.

10. The closure as defined in claim 7 wherein said closure is manufactured of polymeric materials, said band being manufactured of a different colored polymeric material than said closure body.

11. The closure as described in claim 7 wherein said at least one rib is molded as a single annular rib.

* * * * *